US006418975B1

(12) United States Patent
Shimono

(10) Patent No.: US 6,418,975 B1
(45) Date of Patent: Jul. 16, 2002

(54) WOVEN SLIDE FASTENER STRINGER

(75) Inventor: Muchiji Shimono, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/533,566

(22) Filed: Mar. 22, 2000

(30) Foreign Application Priority Data

Apr. 8, 1999 (JP) ..... 11-100776

(51) Int. Cl.[7] ..... A44B 19/40; A44B 19/54; D03D 1/00

(52) U.S. Cl. ..... 139/384 B; 24/392

(58) Field of Search ..... 139/384 B; 24/392

(56) References Cited

U.S. PATENT DOCUMENTS

| | | | | |
|---|---|---|---|---|
| 4,334,556 A | | 6/1982 | Frohlich et al. | |
| 4,597,418 A | * | 7/1986 | Ofusa | 139/384 B |
| 4,678,013 A | * | 7/1987 | Ofusa et al. | 139/384 B |
| 6,105,625 A | * | 8/2000 | Shimono et al. | 139/384 B |

FOREIGN PATENT DOCUMENTS

| | | |
|---|---|---|
| EP | 0 448 265 A1 | 9/1991 |

* cited by examiner

*Primary Examiner*—Andy Falik
(74) *Attorney, Agent, or Firm*—Finnegan, Henderson, Farabow, Garrett & Dunner, LLP

(57) ABSTRACT

A slide fastener stringer having a plurality of coupling elements molded from synthetic resin monofilament woven in a fastener tape in succession along a longitudinal edge thereof, at the same time when the fastener tape is woven, with a plurality of element row binding warp yarns running in parallel to each other. At least two adjacent element row binding yarns disposed on a side toward coupling heads of the coupling elements run over upper and lower leg portions of the coupling elements in the longitudinal direction of the tape, and then run under a foundation weft yarn running below an adjacent coupling element and that adjacent coupling element. Each of the two adjacent element binding warp yarns is woven in this repeating pattern, which suppresses floating of the binding warp yarns after a space portion is formed.

6 Claims, 3 Drawing Sheets

WOVEN SLIDE FASTENER STRINGER

BACKGROUND OF THE INVENTION

1. Field of the Invention

The present invention relates to a woven slide fastener stringer bound on a fastener tape by weaving a continuous element row of synthetic resin monofilament into the fastener tape woven at the same time, along one longitudinal edge thereof.

2. Description of the Related Art

According to a well known woven slide fastener stringer of this kind, as disclosed in, for example, Japanese Patent Publication No. 2-17162, element rows constituted of a plurality of coil-like parallel coupling element portions of synthetic resin monofilament are bound on a fastener tape woven at the same time along one longitudinal edge of the same tape with binding warp yarns and foundation weft yarns.

Each of the coupling element portions comprises a coupling head protruded outward from the longitudinal edge of the fastener tape, upper and lower leg portions extending in parallel inward of the same tape, and a connecting portion for connecting upper and lower leg portions of adjacent coupling element portions. In the slide fastener stringer disclosed in the same publication, foundation weft yarns composed of two-folded yarns by double picks are disposed below the aforementioned lower leg portion of each coupling element portion. That is, every time the weft yarn is inserted, a single coupling element portion is woven in with the same weft yarn.

As shown in FIG. 3 (representation of the coupling head of the coupling element portion is omitted as required to facilitate illustration in the figure), the Publication discloses that the coupling element portion E is supported by 12 binding warp yarns $W_1$ to $W_{12}$ in total. On the connecting portion side of the coupling element portion E, eight warp yarns $W_5$ to $W_{12}$ are guided by repeating a unit of high-high-medium-low in succession in plan view of the fastener tape. On the coupling head side, four warp yarns $W_1$ to $W_4$ are guided by repeating the order of high-medium-low-medium. Here, "high" means that the warp yarn supports the upper and lower leg portions L from above, "medium" means that the warp yarn is disposed between the lower leg portion and a foundation weft yarn w, and "low" means that warp yarn support the foundation weft yarn w and the upper and lower leg portions L from below. Meanwhile, in FIG. 3, representation of the coupling head of the coupling element portion is omitted as requried to facilitate illustration.

Such a weaving structure not only stabilizes a pitch between adjacent coupling element portions but also intensifies the density of the warp yarns constituting a warp yarn pocket without providing a particularly high tension. As a result, the pitch between the coupling element portions is stabilized so that an excellent plasticity and flexibility of the fastener tape can be secured. Thus, the slide fastener can be sewn to an attachment material such as clothes or a bag at a high speed.

However, with respect to the slide fastener stringer disclosed in the above publication, particularly to a manner of mingling of the binding warp yarns with respect to the foundation weft yarn for fixing the parallel coupling element portions, each of the fixing warp yarns is guided by repeating the unit of high-high-medium-low or the unit of high-medium-low-medium as described above. Thus, in either case with respect to the foundation weft yarn w, as shown in FIG. 3, the binding warp yarn runs over three weft yarns w composed of two-folder yarns and then runs below the weft yarn w of next position, and this sequence is repeated.

Usually, upon manufacturing a finally finished slide fastener, with the coupling element row bound on a longitudinal edge of each of two slide fastener stringers engaging each other, a desired number of the coupling element portions are cut out at an interval corresponding to the length of a slide fastener in the longitudinal direction thereof so as to form a so-called space portion to complete the fastener chain. When the coupling element portion is cut out, the coupling head is cut out by cutting a border between the coupling head and the upper and lower leg portions, and after that, the upper and lower leg portions of each coupling element portion is pulled out from a warp yarn pocket. Therefore, when the space portion is formed, the binding warp yarn supporting each coupling element portion from above or below floats, i.e., moves easily in the upward and downward directions, in a region in which the space portion is formed.

On the other hand, since a process for attaching top and bottom end stops, a process for installing the slider and the like are provided after the formation of the space portion for manufacturing the slide fastener, if the binding warp yarn floats too largely, i.e., moves easily too far in the upward direction or the downward direction, due to the formation of the space portion, the binding warp yarns hinder subsequent processes, thereby causing various troubles. Further, the fastener chain is cut at the center of the space portion in the longitudinal direction so as to produce a final slide fastener. The binding warp yarn floating in the space portion as describe above leaves the fastener tape while an end thereof is fixed, because it is little supported by the foundation weft yarn. As a result, the commercial value of the produced slide fastener is lowered or additional work is needed for treating that trouble.

In the slide fastener stringer disclosed in the foregoing publication, the binding warp yarn runs over three weft yarns composed of two-folded yarns with respect to the foundation weft yarn and then is guided below the weft yarns of a next position. As a result, the binding warp yarn floats over a length corresponding to the three coupling element portions, and therefore, in a process after the space portion is formed, the binding warp yarn may be caught or cut out, or an end portion of the coupling element portion adjacent to an end portion of the space portion may slip out of the fastener tape. These troubles cause faulty products.

SUMMARY OF THE INVENTION

Accordingly, the present invention has been achieved to solve the above-described problems, and therefore, an object of the invention is to provide a woven slide fastener stringer, wherein a pitch between adjacent coupling element portions is stabilized and the warp yarns constituting a warp yarn pocket are woven in a high density so that excellent plasticity and flexibility are secured, attachment thereof to a material can be carried out by sewing at high speed and floating of binding warp yarns can be suppressed after a space portion is formed.

The above object is achieved effectively by the present invention.

According to the invention, there is provided a slide fastener stringer in which a plurality of coupling element portions continuously formed from synthetic resin monofilament are woven in a fastener tape comprising plural foundation weft yarns and warp yarns in succession along a side edge thereof, at the same time when the fastener tape is woven, with plural element binding warp yarns in parallel to each other. The coupling element portion comprises a coupling head protruded outward from a side edge of the fastener tape, upper and lower leg portion extending inward of the tape from both ends of the coupling head and a connecting portion for connecting each end of the upper and lower leg portion with upper and lower leg portions of adjacent coupling element portions. Among the plural element binding warp yarns running in parallel, at least two element binding warp yarns disposed on a side toward the coupling head run over an upper face of the upper and lower leg portions of each of the coupling element portions disposed in parallel along a longitudinal direction of the tape and then run under a foundation weft yarn running in parallel to a coupling element portion of a next position and the coupling element portion, each of the element binding warp yarns being woven in this repeating unit.

With such a structure, even when a desired number of the coupling element portions are cut out to form the space portion, because the binding warp yarn in the same cut out portion runs under the foundation weft yarn disposed under the lower leg portion of each coupling element portion and further runs over the foundation weft yarn disposed below the lower leg portion of an adjacent coupling element portion, each binding warp yarn never floats largely. Thus, no considerable trouble occurs in any subsequent manufacturing process of the slide fastener, thereby improving production efficiency.

Preferably, the repeating unit of at least two adjacent element binding warp yarns disposed on a side toward the coupling head is deviated by an amount corresponding to a single adjacent coupling element portion in the longitudinal direction of a tape. As a result, each coupling element portion is supported equally by the binding warp yarn so that the pitch between the coupling element portions is stabilized.

Further preferably, the foundation weft yarn is a two-folded yarn by double pick. By forming a single foundation weft yarn with two-folded yarn by double pick, even when the density of the weft yarn is reduced to ½ with respect to normal case, the function of the fastener tape is not lost, and further the production efficiency doubles.

Further preferably, the foundation weft yarn is a two-folded yarn lain-in by double picks and each coupling element portion is woven into the fastener tape each time when the foundation weft yarn is inserted by double pick. According to this, in addition to the operation of the above, the plasticity and flexibility of the fastener tape are secured although the weft yarn density is at necessary minimum. Thus, the slide fastener can be attached to flexible attachment material without losing the flexibility and be put along the attachment material at the time of sewing also.

Also preferably, a foundation warp yarn is disposed between the element binding warp yarn disposed nearest from the coupling head and the coupling head, and the foundation warp yarn runs alternately over and under adjacent weft yarns inserted by double picks alternately. The foundation weft yarn inserted by double pick is branched to back and forth directions at a tape end on a side of the coupling element row so as to form a tape end. Thus, usually, the branch end mingles with the binding warp yarn so as to form a tape end, the tape end is constructed by mingling with the foundation warp yarn according to the present invention. Further, in that mingling condition, the foundation warp yarns run over and under the adjacent foundation weft yarn by double picks, alternately so as to secure stabilization of the structure of the tape end. Further, no looseness is caused at the branch end of the foundation weft yarn even when the space portion is formed.

DESCRIPTION OF THE PREFERRED EMBODIMENTS

Figure 1:
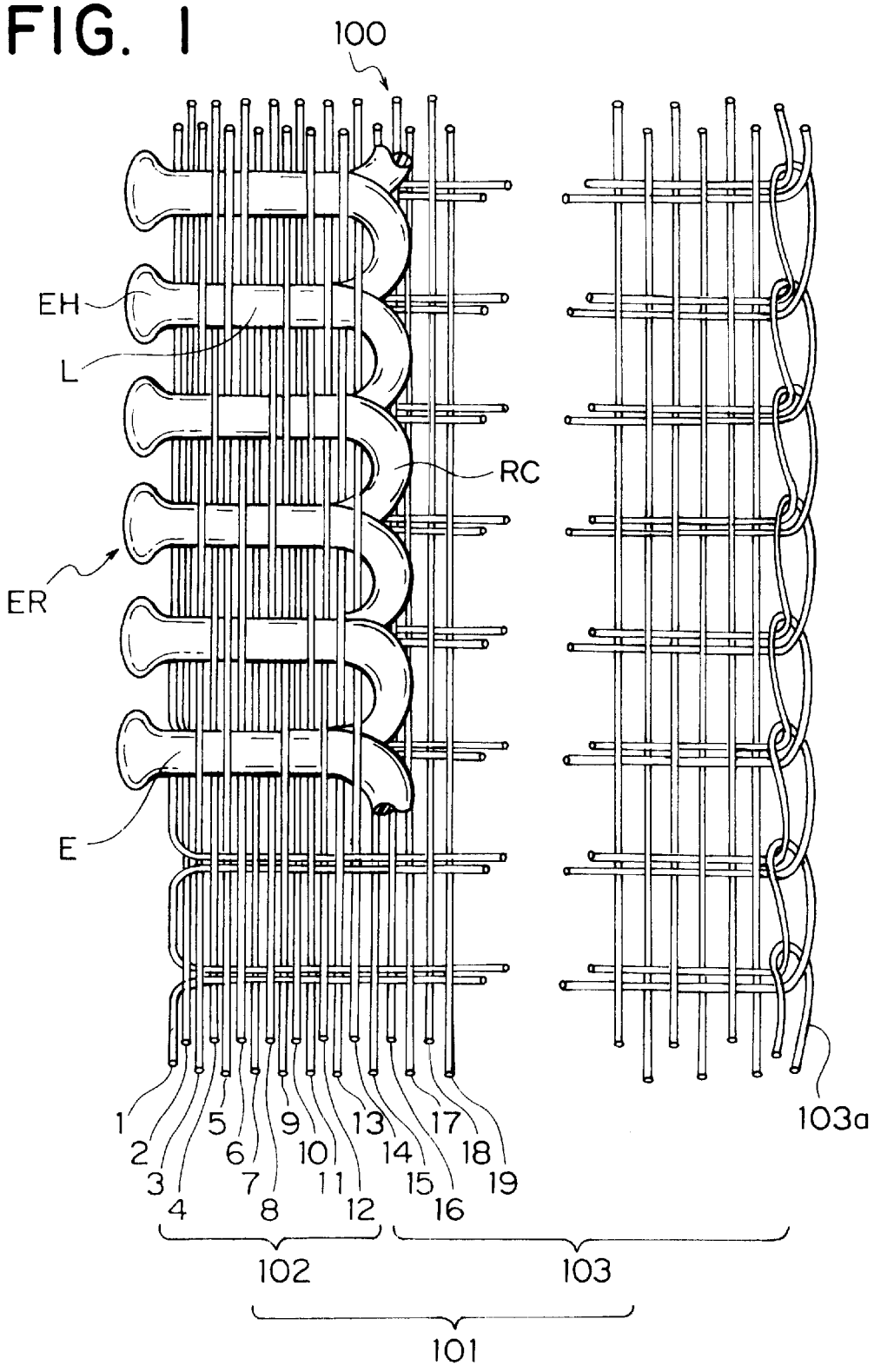
FIG. 1 is a partially broken plan view showing a slide fastener stringer according to an embodiment of the present invention.
Figure 2:
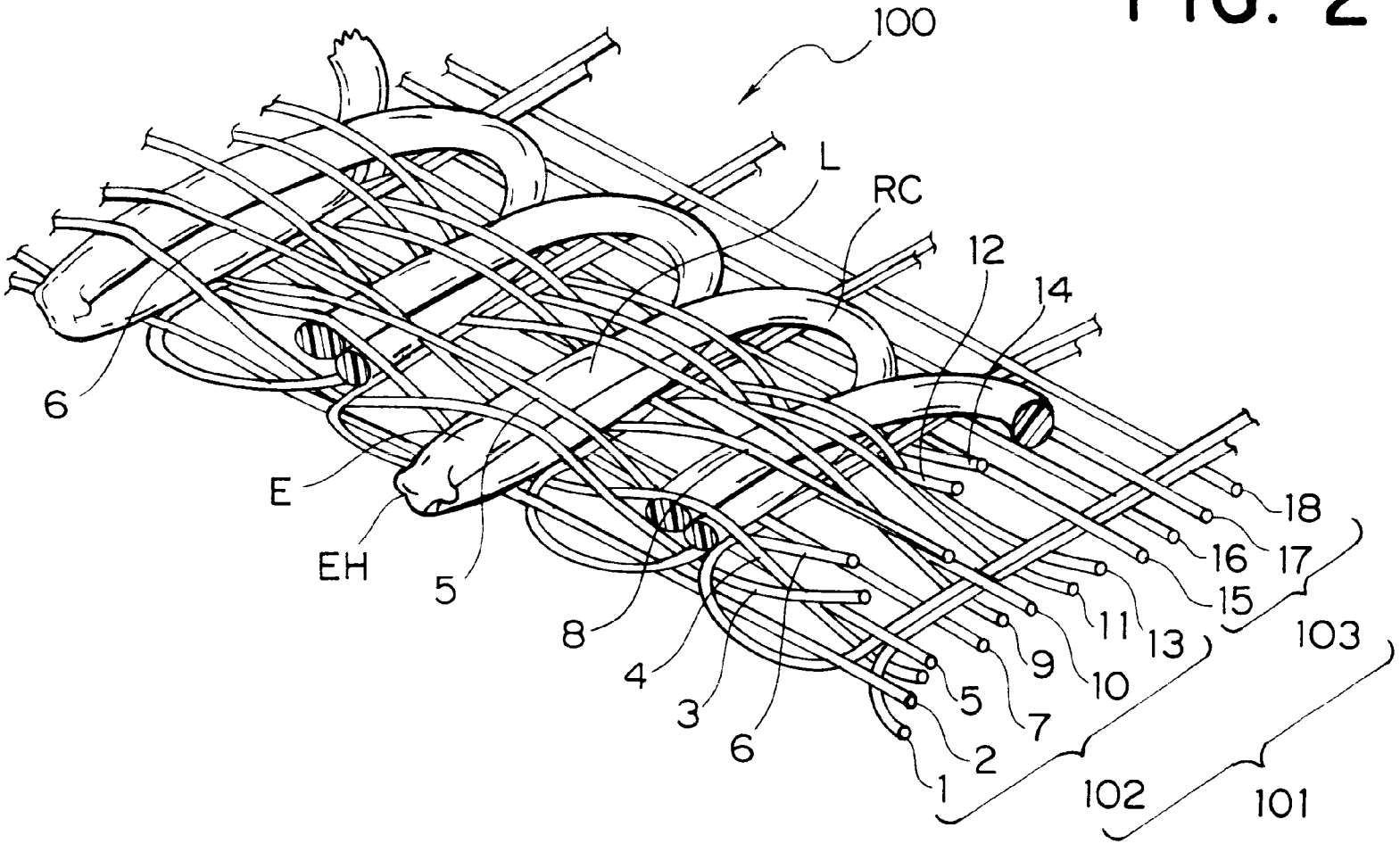
FIG. 2 is a partial perspective view showing an attachment structure of the coupling element row of the slide fastener stringer of FIG. 1.
Figure 3:
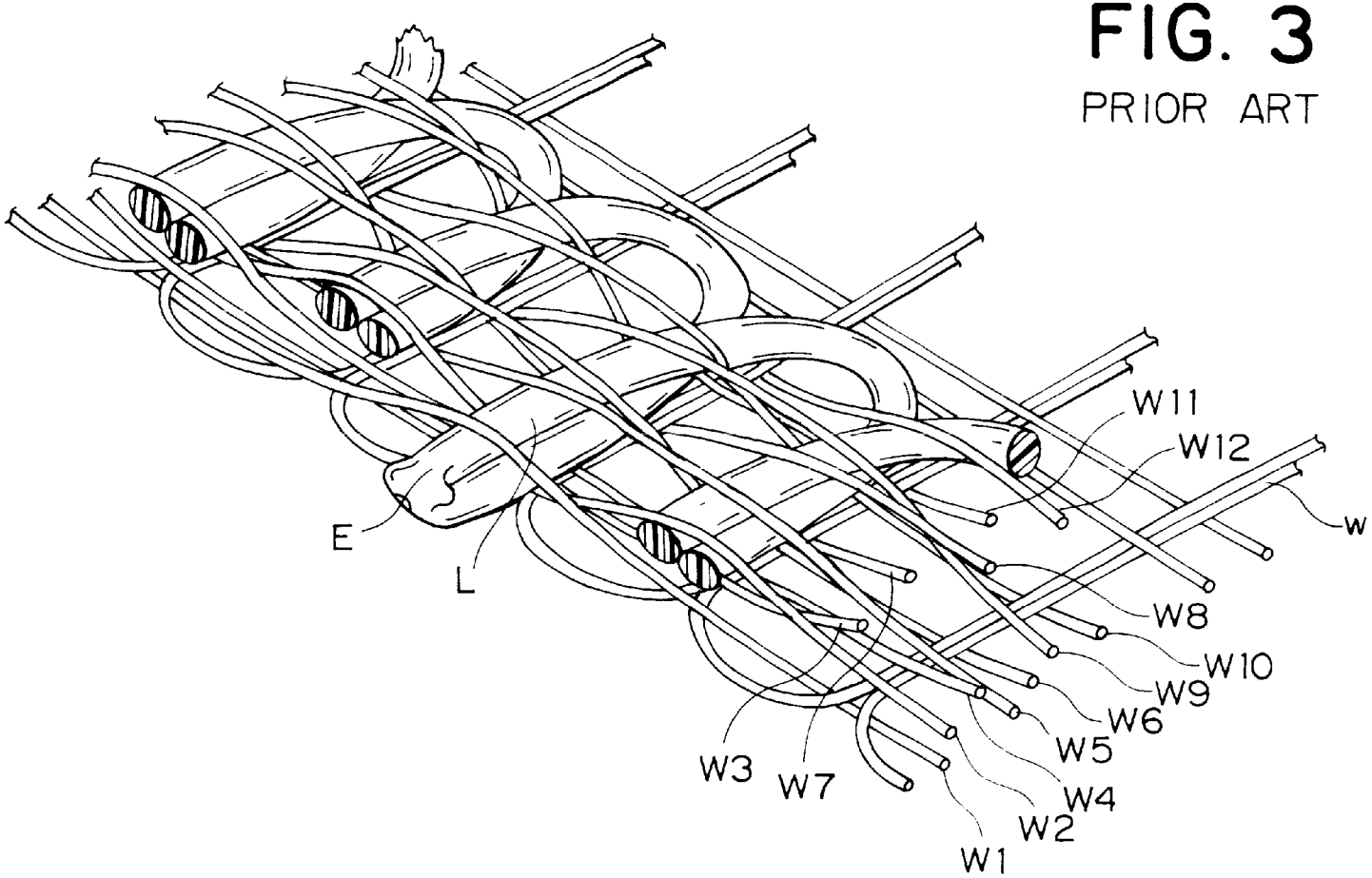
FIG. 3 PRIOR ART
FIG. 3 is a partial perspective view showing an attachment structure of the coupling element row of a conventional slide fastener stringer.

Hereinafter, the preferred embodiments of the present invention will be described in detail with reference to the accompanying drawings. FIGS. 1 and 2 show a typical embodiment of the present invention. FIG. 1 is a partially broken plan view of the coupling element row while representation of a central portion of the fastener tape in the width direction is omitted. FIG. 2 is a partial perspective view of an attaching portion of the coupling element row of the woven slide fastener stringer. Although in these Figures, various warp and weft yarns are represented in relatively small sizes and its weaving structure is presented roughly for convenience for understanding, actually, considering the function of the fastener, the various warp and weft yarns have a required size and the weaving structure is formed finely, so that a structure allowing the fastener to exert its function is secured.

In the woven slide fastener stringer 100 of the present invention also, the coupling element row ER is woven integrally in the coupling element row binding region 102 of the fastener tape 101 comprising the coupling element row binding region 102 and tape main body portion 103. The foundation weft yarn which is a component yarn of the fastener tape 101 is consisted of a two-folded yarn because it is inserted by reciprocating (double pick) a carrier bar (not shown) into a shuttle road of a warp yarn opening. The warp yarns comprise foundation warp yarns which are component of foundation structure of the fastener tape and binding warp yarns for the coupling element row ER.

Ten of the element row binding warp yarns 3, 4, 5, 6, 8, 9, 11, 12, 13 and 14 are disposed in the coupling element row binding region 102 and a plurality of foundation warp yarns 2, 7, 10, 15, 16, 17, 18, 19, . . . are disposed in the coupling element row binding region 102 and the tape main body portion 103. These warp yarns are arranged in the order of reference numerals from an outside edge of the coupling element row binding region 102 and supplied onto a loom (not shown).

A plurality of the coupling element portions E molded continuously in a coil shape from synthetic resin monofilament is woven into the coupling element row binding region 102 and bound in the aforementioned structure. The coupling element portion E comprises a coupling head EH extending outward from the coupling element row binding region 102 of the fastener tape 101, a upper and lower leg portions L extending in parallel inward of the fastener tape 101 from both ends of a direction perpendicular to the fastener tape 101 of the coupling head EH and a connecting portion RC for connecting each end of the upper and lower leg portions L with the upper/lower leg portions L of the coupling element portions E longitudinally adjacent in the tape direction.

The coupling element portion E is guided by a carrier bar (not shown) which reciprocates over a predetermined length inwardly from an end of the tape when the foundation weft yarn 1 is inserted by double picks, so as to be molded and inserted. Therefore, the respective weft yarn 1 inserted by double picks exists below the upper and lower leg portions L of the coupling element portion E.

A knitting needle (not shown) is inserted into a loop-like return end of the foundation weft yarn 1 at the end of the tape main body portion 103, and by hooking the return loop end of the weft yarn 1 at a next position, it comes out of the preceding loop end. Then, the loop ends are joined together in succession so as to form a selvage portion 103*a* of the tape main body portion 103.

According to this embodiment, among the aforementioned binding warp yarns 3, 4, 5, 6, 8, 9, 11, 12, 13, and 14, the two adjacent binding warp yarns 3 and 4 near the coupling head EH of the coupling element portion E run over the upper and lower leg portions L, and then run under the foundation weft yarn 1 disposed below the upper and lower leg portions L at a next position while their repeating unit is deviated by one pitch of the coupling element portion E in the longitudinal direction of the tape. Consequently, this is repeated so that the coupling element portion E is woven into the fastener tape 101 in succession and bound therein.

Two binding warp yarns 5 and 6 next to the aforementioned two binding warp yarns 3 and 4 run over central portions of the upper and lower leg portions L of two coupling element portions E, run under the central portion of the coupling element portion E at a next position, and between the central portion of the coupling element portion E and the foundation weft yarn 1 located below the coupling element portion E at a further next position, while the repeating unit is deviated by one pitch. Further, it runs under the foundation weft yarn 1 located below the central portion of the upper and lower leg portion L of the coupling element portion E at a next position. This procedure is repeated. A foundation warp yarn 7 following these two binding warp yarns 5 and 6 is disposed and runs over or under the foundation weft yarn 1 running in parallel, alternately, so that it is always located below the coupling element portion E.

Two binding warp yarns 8 and 9 disposed adjacent to the foundation warp yarn 7 such that they are disposed inside of the tape with respect thereto run while the repeating unit is deviated by one pitch like the aforementioned two binding warp yarns 5 and 6. A foundation warp yarn 10 disposed inside with respect to the binding warp yarns 8 and 9 runs over and under the foundation weft yarn 1 disposed in parallel alternately, like the aforementioned foundation warp yarn 7, so that it is always located below the coupling element portion E.

Four binding warp yarns 11 to 14 disposed next to foundation warp yarn 10 such that they are located inside with respect thereto bind the connecting portion RC of the upper and lower leg portions L of the coupling element portion E. The respective binding warp yarns 11 to 14 run in the same repeating unit as the binding warp yarns 3 and 4 disposed near the coupling head EH. That is, the binding warp yarns 11 to 14 run over a portion near the connecting portion RC of the upper and lower leg portions L and run under the foundation weft yarn 1 disposed below the upper and lower leg portions L at a next position, while the repeating unit is deviated by one pitch of the coupling element portion E in the longitudinal direction of the tape. This procedure is repeated so as to weave the coupling element portion E into the fastener tape 101 in succession and bind it therein.

The foundation warp yarns 15–19 and the foundation weft yarn 1 constituting the tape main body portion 103 are disposed such that they intersect each other in a zigzag pattern so as to form so-called plain weaving structure. On the other hand, according to this embodiment, a foundation warp yarn 2 is disposed on the tape end side of the two binding warp yarns 3 and 4 located near the coupling head EH.

If the coupling element rows ER opposing each other of a pair of the slide fastener stringers 100 of this embodiment having such a structure are cut out in a desired length at the interval corresponding to the length of the slide fastener in the longitudinal direction thereof so as to form a space portion, as understood from FIGS. 1 and 2, the foundation warp yarn 2 and binding warp yarns 3 and 4 run over and under the foundation warp yarn 1 in parallel alternately, while their pitch is deviated by the amount corresponding to a weft yarn, at the end portion of the fastener tape 101 on the side of the coupling head EH in the same space portion. Therefore, after the space portion is formed, the respective warp yarns 2 to 4 never float. Thus, in a subsequent slide fastener manufacturing process, there should be no influence of the warp yarns 2 to 4 so that production thereof is stabilized thereby producing a high quality product at high speed.

In the above embodiment, a typical woven slide fastener stringer of the present invention has been described. However, the present invention is not limited to the aforementioned embodiment, and it is permissible to use single yarn instead of the two-folded yarn as the foundation weft yarn. Further, the number, disposition thereof and weaving structure of the binding warp yarns may be designed freely except several binding warp yarns on a side toward the coupling head.

What is claimed is:

1. A slide fastener stringer in which a plurality of coupling element portions continuously formed from synthetic resin monofilament are woven in a fastener tape using a plurality of foundation weft yarns and warp yarns in succession along a side edge thereof, at the same time when the fastener tape is woven, with a plurality of element row binding warp yarns in parallel to each other, and wherein each of said coupling element portions includes a coupling head which protrudes outward from a side edge of said fastener tape, an upper leg portion and a lower leg portion, both extending inward from the side edge of the tape from both ends of the coupling head, wherein the lower leg portion is positioned below the upper leg portion, and a connecting portion for connecting each end of an upper leg portion or a lower leg portion with a lower leg portion or an upper leg portion, respectively, of an adjacent coupling element portion, and wherein among said plurality of element row binding warp yarns running in parallel, at least two adjacent element row binding warp yarns of the plurality of element row binding warp yarns disposed on a side toward said coupling heads of said coupling element portions run over the upper and lower leg portions of one coupling element portion, and then run under a foundation weft yarn running below an adjacent coupling element portion and said adjacent coupling element portion, each of said at least two adjacent element row binding warp yarns being woven in this repeating pattern.

2. A slide fastener stringer according to claim 1, wherein said repeating pattern of one of the at least two adjacent element row binding warp yarns is deviated, with respect to the other of the at least two adjacent element row binding warp yarns, by an amount corresponding to a single adjacent coupling element portion in the longitudinal direction of the tape.

3. A slide fastener stringer according to claim 1, wherein said foundation weft yarn is a two-folded yarn by double pick.

4. A slide fastener stringer according to claim 3, wherein said foundation weft yarn is the two-folded yarn laid-in by double pick and each coupling element portion is woven into said fastener tape each time when the foundation weft yarn is inserted by double pick.

5. A slide fastener stringer according to claim 3, wherein a foundation warp yarn is disposed between the element binding warp yarn disposed nearest from said coupling head and said coupling head and said foundation warp yarn runs alternately over and under adjacent weft yarns inserted by double picks.

6. A slide fastener stringer according to claim 1, wherein said at least two element row binding warp yarns are adjacent to each other.

* * * * *